US006003271A

United States Patent [19]

Boyer et al.

[11] Patent Number: 6,003,271

[45] Date of Patent: Dec. 21, 1999

[54] PRE-CAST SECURITY VAULT

[76] Inventors: Mark L. Boyer, 9310 Reid Lake, Houston, Tex. 77064; Michael E. Barker, 411 Carriage Creek La., Friendswood, Tex. 77456

[21] Appl. No.: 08/937,681

[22] Filed: Sep. 25, 1997

[51] Int. Cl.[6] ..... E04B 1/343

[52] U.S. Cl. ..... 52/79.5; 52/79.9; 52/745.13

[58] Field of Search ..... 52/79.1, 79.9, 52/79.12, 79.13, 79.14, 143, 251, 745.13, 745.2; 220/1.5

[56] References Cited

U.S. PATENT DOCUMENTS 5,081,805 1/1992 Jazzar ..... 52/79.2

5,210,984 5/1993 Eckel ..... 52/79.5

5,724,774 3/1998 Rooney ..... 52/79.5

*Primary Examiner*—Beth Aubrey

*Attorney, Agent, or Firm*—Jenkens & Gilchrist A Professional Corporation

[57] ABSTRACT

An easily constructed, highly secure, walk-in vault uses pre-cast panels. A door frame is molded into one of the panels. The panels have interlocking joints with adjacent panels. The interlocking joints are protected with continuous, double burglary-proof seams situated in the interior of the vault. Abutting panels are securely held together by metal rods that penetrate the interlocking joints.

16 Claims, 7 Drawing Sheets

PRE-CAST SECURITY VAULT

BACKGROUND OF THE INVENTION

It is sometimes desirable to provide a walk-in, highly secured, lockable vault inside a building or habitat to protect property from damage or theft or to serve as a shelter from natural disaster or intruders.

These walk-in vaults are often required to comply with various building codes and satisfy requirements set by regulatory bodies for security vaults. This has led to the walk-in vault being built in-place in a building by forming walls of substantial building material such as concrete, steel, or brick to form an enclosure which is fire-resistant and burglary-proof for a rated time.

The fact that these walk-in vaults have to be built in-place makes them very expensive for the average person and prolongs construction time of the building. It also makes the addition of a vault to a building that is already constructed difficult. Thus it is desirable to have a fire-resistant, burglary-proof, walk-in security vault that can be built inexpensively and incorporated into a building quickly.

SUMMARY OF THE INVENTION

In accordance with one aspect of the invention, a modular vault comprises a plurality of side, end, and roof panels. The panels are pre-cast from a durable material and connected together to define a walk-in enclosure. A floor slab forms the base of the walk-in enclosure. A door frame is molded in at least one of the side or end panels. A door which controls access to the walk-in enclosure is hingedly attached to the door frame. Joint means for engaging abutting panels are provided on the inner surfaces and peripheral edges of the panels. A plurality of metal plates are attached to the inner surfaces of the panels at a location proximate the peripheral edges. The edges of the metal plates contact when the panels are connected by the joint means. A plurality of metal connectors are welded to the metal plates adjoining at corners of the abutting panels. The metal connectors seal the corners of the abutting panels, thereby making the walk-in enclosure substantially vapor-tight.

In accordance with another aspect of the present invention, a unitary vault includes a housing body made of a durable material. The housing body defines a substantially vapor-tight enclosure. A door frame is fixedly mounted to a side of the housing body. A door providing access to the enclosure is hingedly attached to the door frame. A plurality of hooks are mounted on the housing body. The hooks facilitate hoisting of the housing body.

DESCRIPTION OF THE PREFERRED EMBODIMENTS

Figure 1:
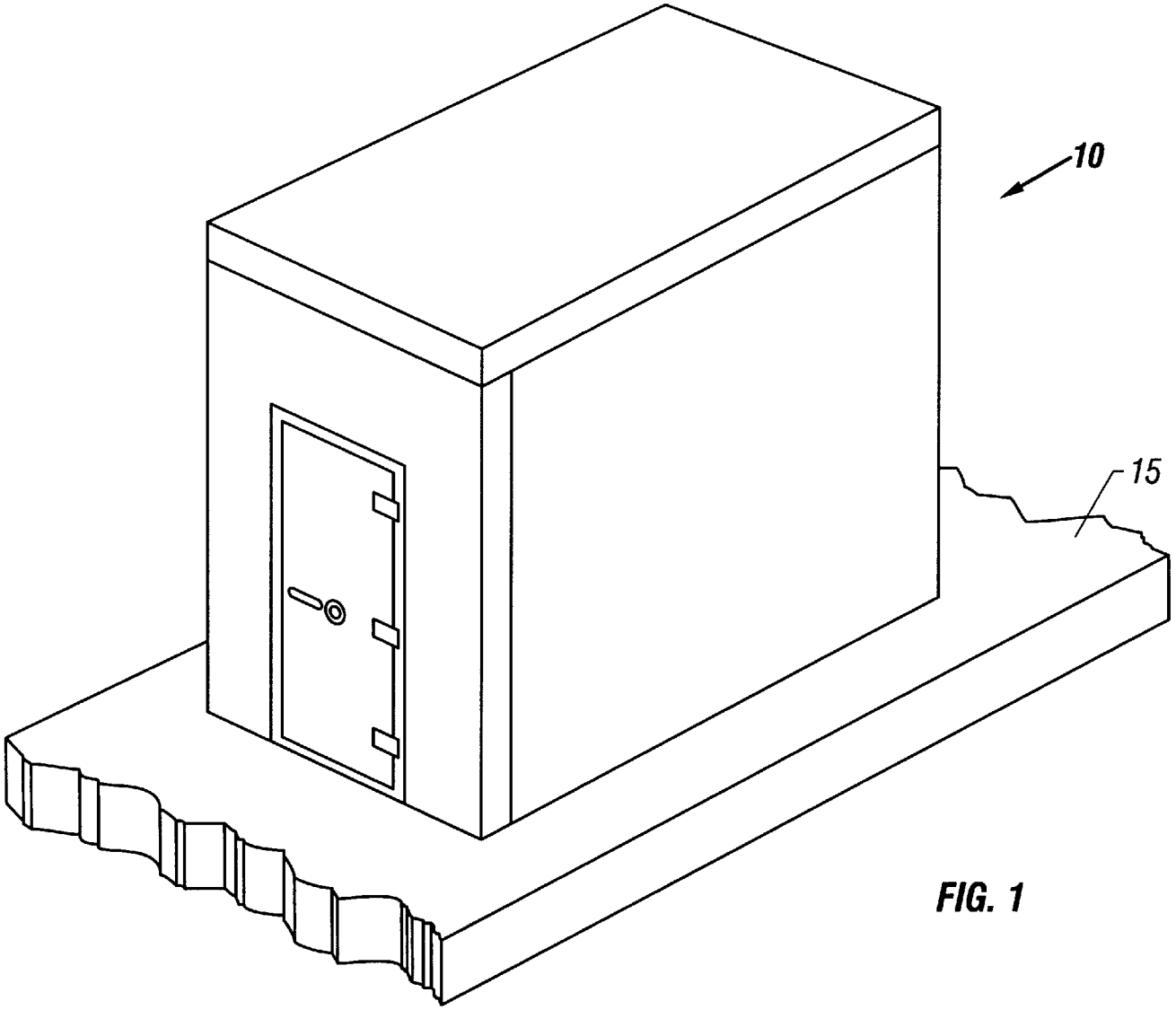
FIG. 1 is a perspective view of one embodiment of the present invention.

Referring to the drawings wherein the reference characters are used for like parts throughout the several views, FIG. 1 depicts a walk-in vault 10 completely assembled and resting on a footing 15 at a construction site.

Figure 2:
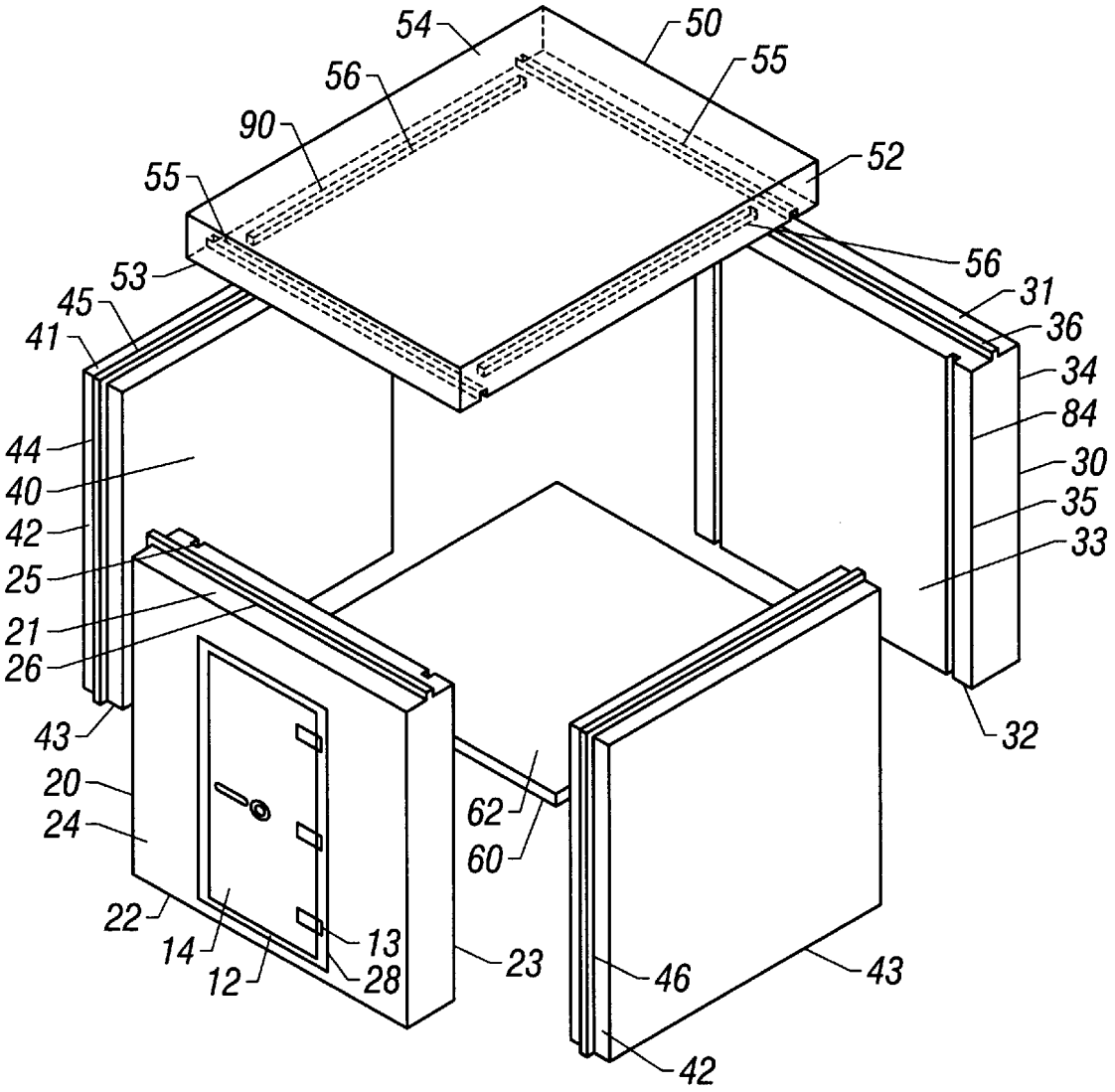
FIG. 2 is an exploded assembly view of the embodiment shown in FIG. 1.

As shown in FIG. 2, the walk-in vault 10 has a front wall 20, rear wall 30, side walls 40, roof slab 50, and floor slab 60. While the walk-in vault 10 is illustrated as a four-wall embodiment, it should be understood that each wall may be constructed from a series of interlocking, pre-cast panels.

The front wall 20 has a top edge 21, a bottom edge 22, an inner surface 23, and an outer surface 24. A pair of elongated grooves 25 run from the top edge 21 to the bottom edge 22. The top edge 21 includes an outwardly extending ridge 26 integrally formed with the front wall 20.

A door frame 12 is integrally formed with the front wall 20. A door 14 is attached to the door frame 12 in the front wall 20 by means of hinges 13. The door 14 is preferably a fire-resistant, burglary-proof vault door with security locks and bolts.

The rear wall 30 has a top edge 31, a bottom edge 32, an inner surface 33, and an outer surface 34. A pair of elongated grooves 35 run from the top edge 31 to the bottom edge 32. The top edge 31 has an outwardly extending ridge 36 integrally formed with the rear wall 30.

The side walls 40 have top edges 41, side edges 42, bottom edges 43, and an inner surface 44. Each top edge 41 has an outwardly extending ridge 45 integrally formed with the side wall 40. Each side edge 42 has an outwardly extending ridge 46 integrally formed with the side wall 40.

To form an interlocking walk-in space, the ridges 46 on the side edges 42 of the side walls 40 mate with the grooves 25 in the front wall 20 and the grooves 35 in the rear wall 30.

The roof slab 50 has a peripheral edge 52, an inner surface 53, and an outer surface 54. Elongated grooves 55 and 56 are provided on the inner surface 53 of the roof 50. The elongated grooves 55 and 56 run parallel to the peripheral edges 52 of the roof 50. The elongated grooves 55 mate with ridge 26 on the front wall 20 and the ridge 36 on the rear wall 30. The elongated grooves 56 mate with the ridges 45 on the side walls 40.

Figure 3:
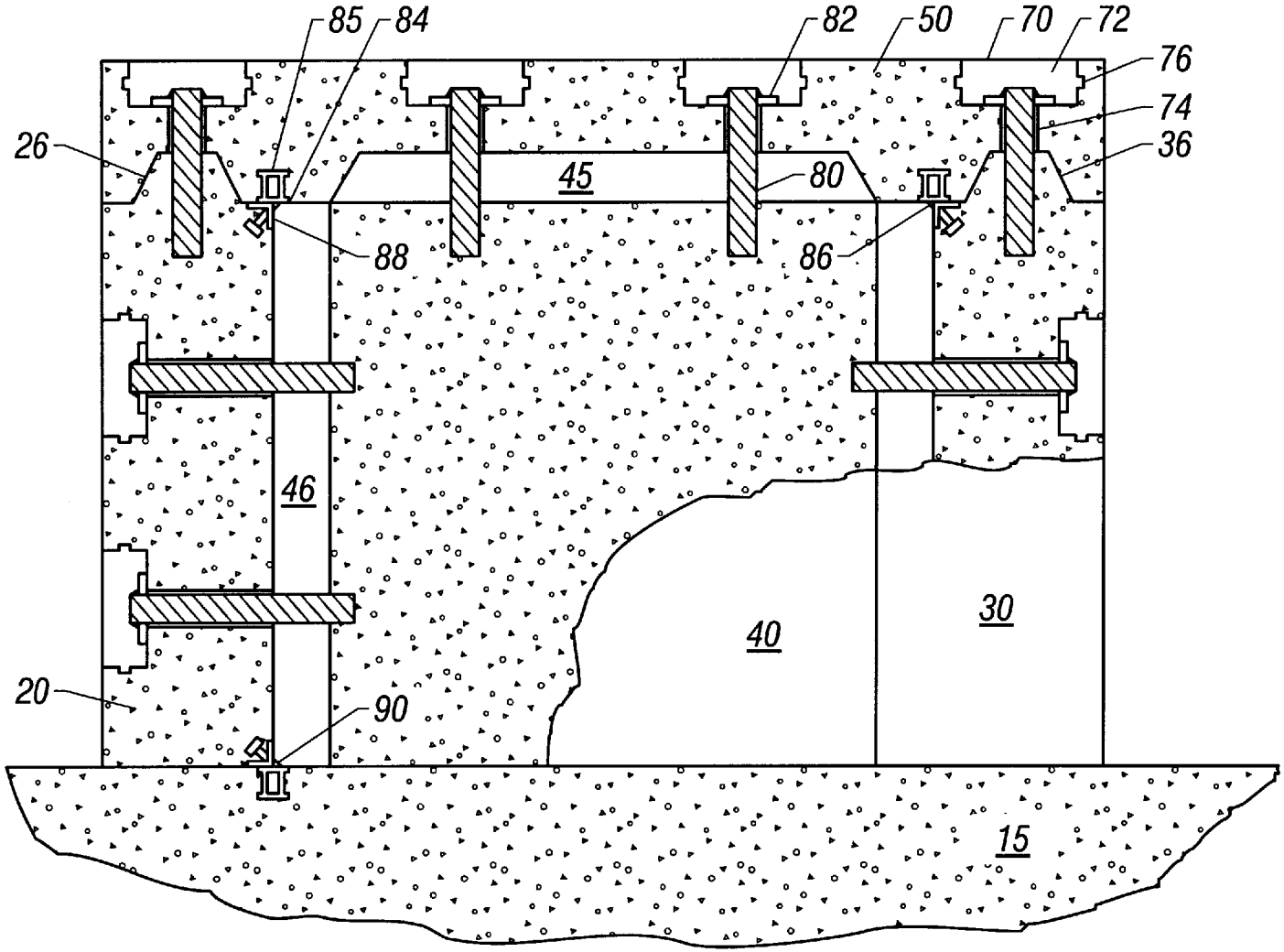
FIG. 3 is a side view of FIG. 1 in half section showing connections between adjoining walls and adjoining walls and roof.

As shown in FIG. 3, apertures 70 are spaced along the perimeters of the front wall 20, the rear wall 30, and the roof slab 50. The apertures 70 intercommunicate with the grooves 25, 35, and 55 and 56 in the front wall 20, rear wall 30, and roof slab 50, respectively. Each aperture 70 has an upper portion 72 and a lower portion 74. The upper portion 72 has a key-way 76.

Metal rods 80 are molded into the front wall 20, the rear wall, 30, and the side walls 40. The metal rods 80 protrude through the ridges 26, 36, and 45 and 46 on the walls 20, 30, and 40, respectively. Portions of the metal rods 80 protruding from top edges 21, 31, and 41 of the walls 20, 30, and 40, respectively, mate with the apertures 70 in the roof slab 50 when the ridges 26, 36, and 45 on the top edges of the walls 20, 30, and 40, respectively, mate with the grooves in the roof slab 50. Similarly, portions of the metal rods 80 protruding from the side edges 42 of the side walls 40 mate with the apertures 70 in the walls 20 and 30 when the ridges on the side edges 42 of the side walls 40 mate with the grooves 25 and 35 in the walls 20 and 30, respectively.

Washers 82 are welded to the metal rods 80 to keep the connected walls from pulling apart. The spaces in the upper portion 72 of the apertures 70 may be filled with grout to prevent access to the metal rods. The key-ways 86 prevent grouts inserted into the spaces in the upper portion 72 of the apertures 70 from falling out.

Metal plates 84 are cast in the walls 20, 30, and 40 and roof 50. The metal plates 84 are held in place by means of studs 85. The surfaces of the plates 84 are flushly arranged with the inner surfaces of the walls and roof flab. The plates 84 in the walls contact when the walls are fitted together. Contacting plates 84 are welded to metal connectors 86 using any suitable welding material.

Advantageously, the double, fillet welds 88 formed by welding the plates 84 to the metal connectors 86 result in a stronger holding power than usually available if the plates 84 are directly welded together. Also, the continuity of the welds 88 provide a vapor-tight enclosure within the vault, thus protecting the contents of the vault from contaminants such as moisture and smoke and allowing the atmosphere in the vault to be controllable. The metal connectors 86 shield the fillet welds 88 from intruders, thus making it difficult for intruders to rupture the fillet welds 88 from outside the vault.

The vault 10 is secured to the footing 15 by continuous, fillet welds 90. The welds 90 help in providing a vapor-tight enclosure within the vault 10 and in preventing water from seeping into the vault to damage the property in the vault. The welds 90 may be covered by the floor slab 60.

Conduits may be provided in the walls to allow lighting and security systems and air passageways to be installed in the vault.

The walls and roof are preferably pre-cast from monolithically poured concrete. The poured concrete may be reinforced with steel bars to prevent hairline cracking in the vault structure. Any other suitable material that satisfies requirements set by regulatory bodies for security vaults may also be used to pre-cast the walls, roof, and floor. The thickness of the walls, roof, and floor may be varied to suit the particular building in which the vault is to be used and to reduce the overall cost of the vault.

The door frame 12 may be integrally formed in the front wall 20 by fitting the door frame 12 to an outer mold shell and pouring concrete monolithically into the mold cavity formed between the outer mold shell and an inner mold core. The concrete snugly holds the door frame 12 in place and eliminates the need for special fasteners to hold the door frame 12 to the front wall 20.

The floor slab 60 may be pre-cast at a manufacturing plant or formed at the construction site by pouring concrete onto the portion of footing 15 within the walk-in space defined by interlocking the walls 20, 30, and 40.

The vault 10 is generally assembled at a construction site as follows. The bottom edge 21 of the front wall 20 is positioned on a footing at the construction site. The bottom edges 43 of the side walls 40 are positioned on the footing and connected to the front wall 20 by mating the ridges 46 on the side edges 42 of the side walls 40 with the grooves 25 in the front wall 20. The rear wall 30 is positioned on the footing and connected to the side walls 40 by mating the grooves 35 in the rear wall 30 with the ridges 46 on the side edges 42 of the side walls 40.

The walls 20, 30, and 40 are welded to the footing. A pre-cast floor slab 60 may be lowered into the walk-in enclosure defined by the interlocking walls 20, 30, and 40. Alternately, concrete may be poured onto the portion of the footing within the walk-in enclosure formed by the walls. The poured concrete becomes the floor slab 60.

The roof slab 50 is placed on top of the walls 20, 30, and 40 by matching the grooves 55 and 56 on the roof 50 with the ridges 26, 36, and 45 on the top edges of the walls 20, 30, and 40, respectively. Metal connectors 86 are welded to the metal plates 84 in the corners formed between adjoining walls and between the walls and the roof.

Figure 4:
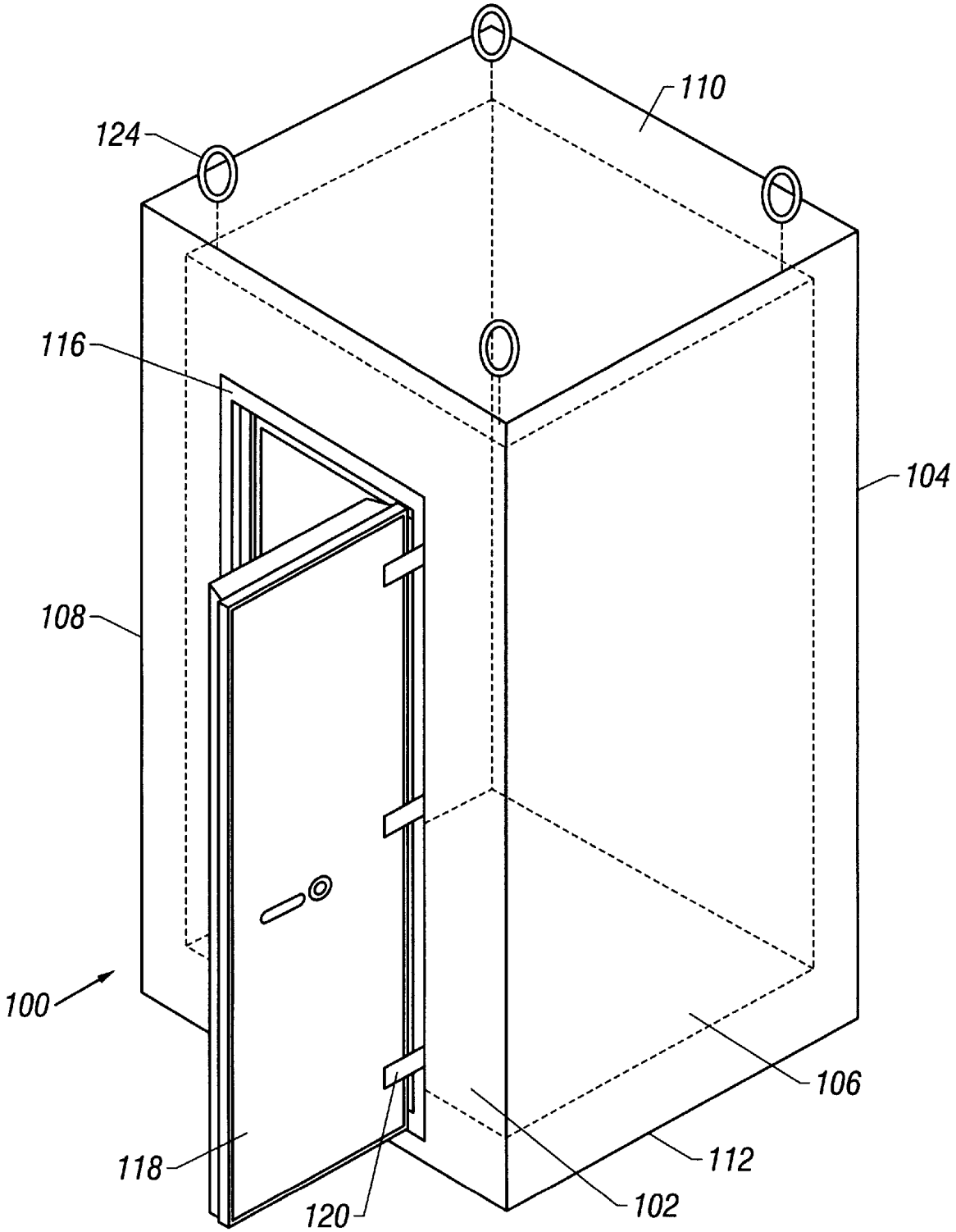
FIG. 4 is a perspective view of another embodiment of the present invention.

An alternate embodiment replaces the front wall 20, the rear wall 30, the side walls 40, the roof slab 50, and the floor slab 60 with a unitary housing body 100 as shown in FIG. 4. The unitary housing body has a front portion 102, a rear portion 104, a first side portion 106, a second side portion 108, a roof portion 110, and a floor portion 112.

The housing body is pre-cast from reinforced concrete by pouring concrete into a cavity defined by an inner mold core and an outer surrounding mold shell. A door frame 116 is integrally formed with the housing body 100. A door 118 is mounted on the door frame 116 by means of hinges 120. The door 14 is preferably a fire-resistant, burglary-proof vault door.

Advantageously, the housing body 100 does not have seams that are prone to penetration by intruders. The enclosure defined within the housing body is also vapor-tight.

Figure 5A:
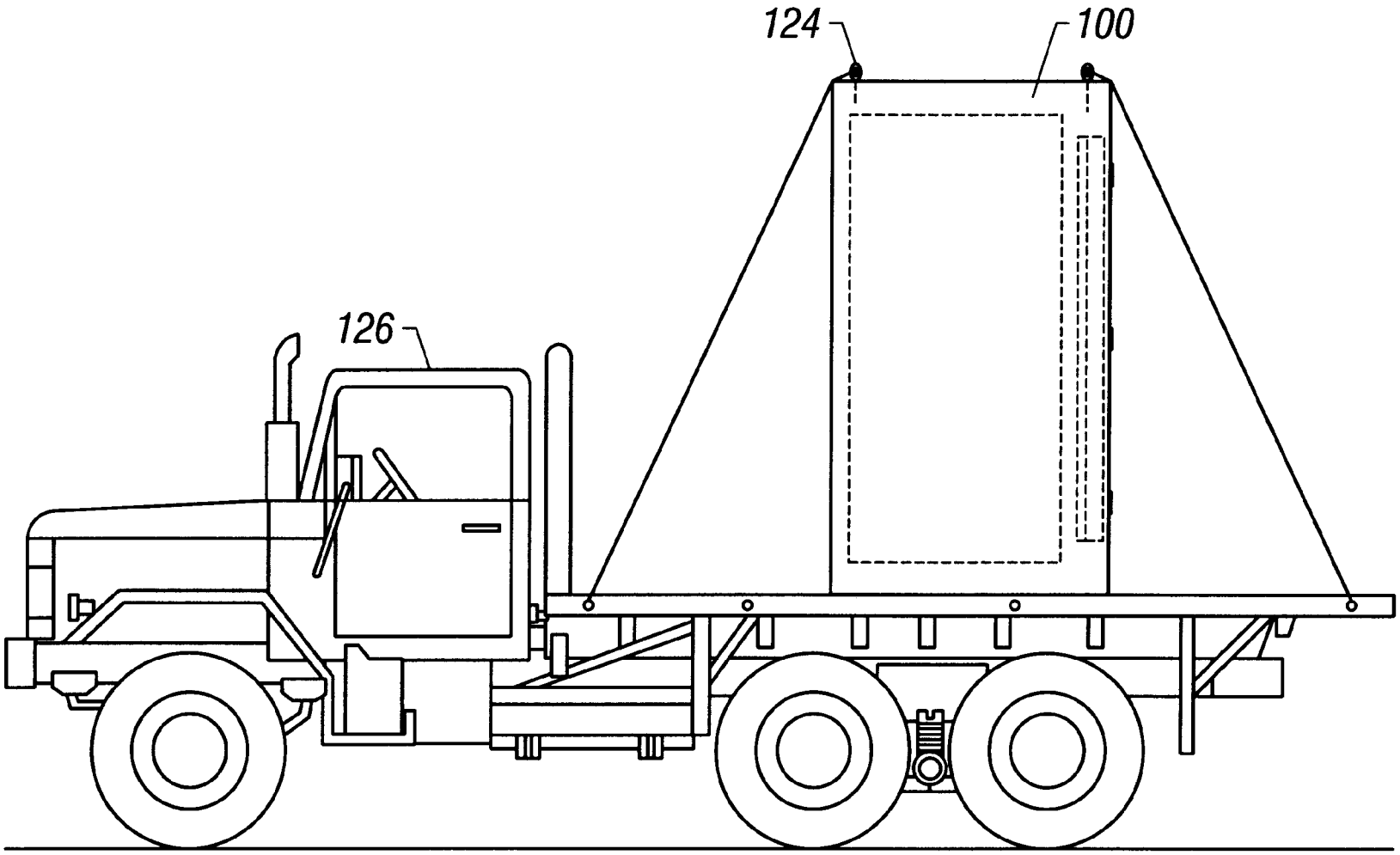
FIG. 5*a* shows one embodiment of the present invention being transported to a construction site.
Figure 5B:
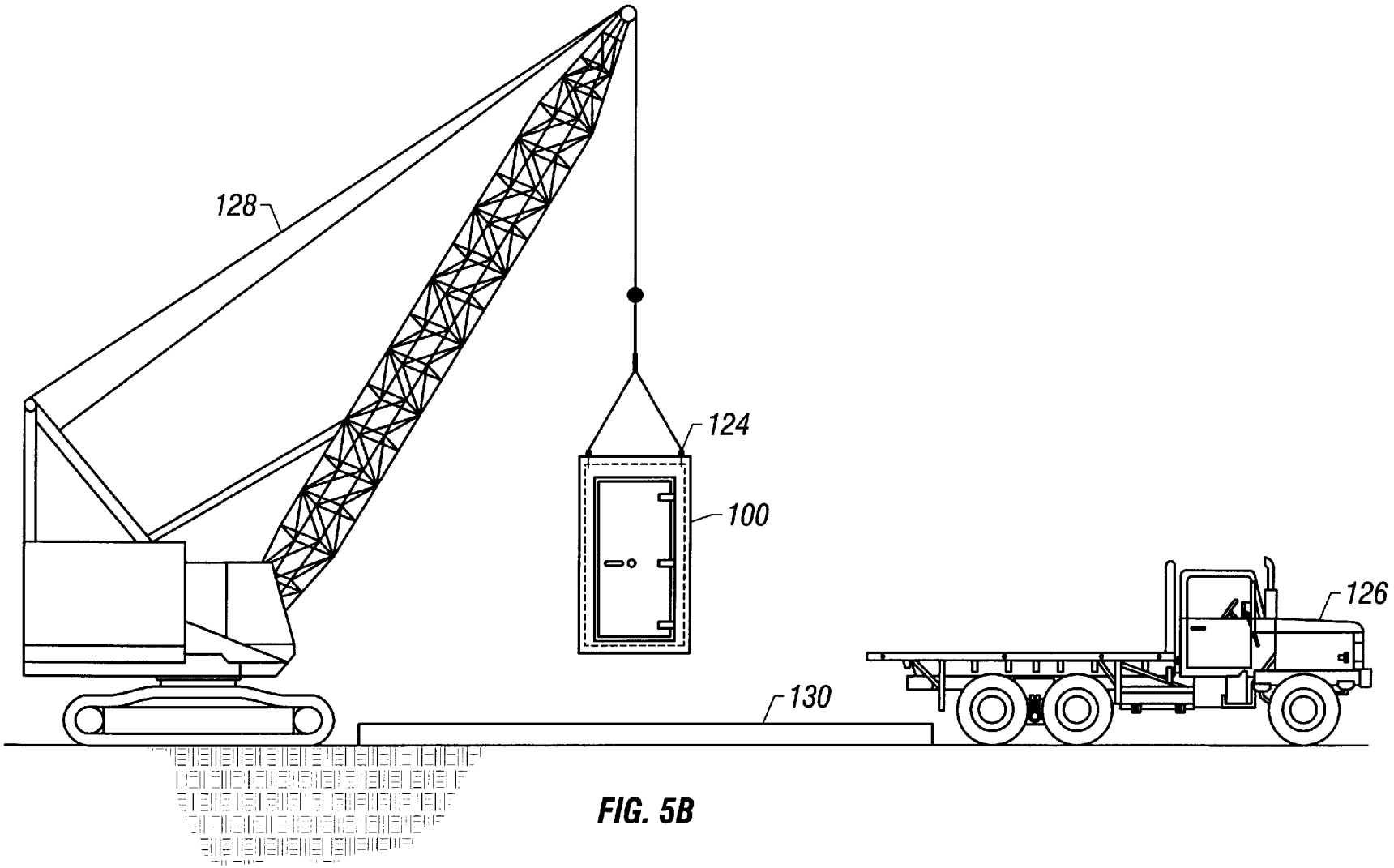
FIG. 5*b* shows one embodiment of the present invention being set on the slab of a building with a crane.
Figure 6:
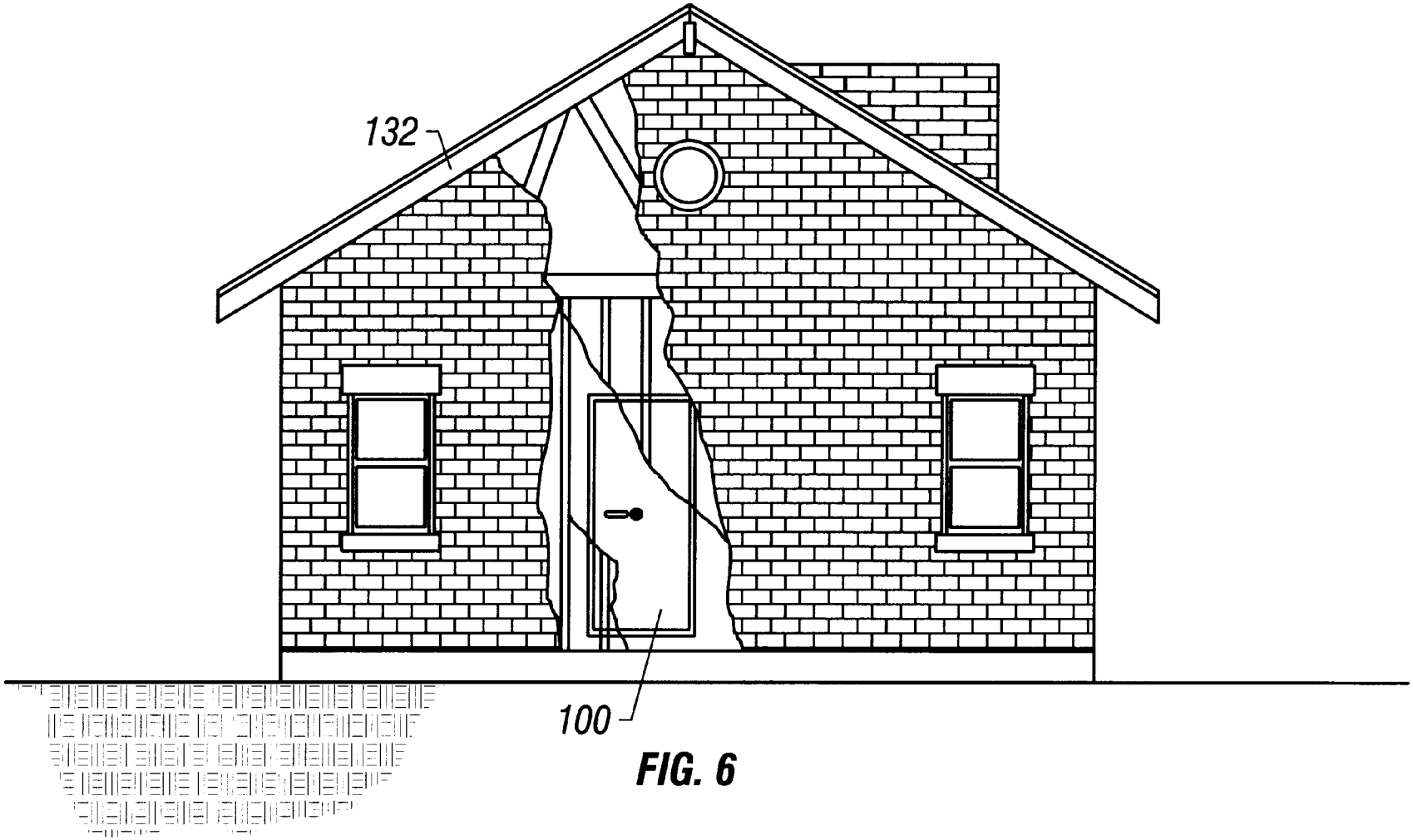
FIG. 6 shows how one of the embodiments of the present invention is incorporated into a building.

To facilitate transporting of the housing body 100, the roof portion 110 of the housing body 100 is provided with hooks 124. The hooks 124 provide anchors for a crane to hoist the housing body 100 onto a truck or position the housing body 100 on a footing at a construction site. FIG. 5*a* shows the housing body 100 being transported to a construction site on a truck 126. FIG. 5*b* shows a crane 128 engaging the hooks 124 of the housing body 100 and lowering the housing body 100 to a footing 130 at a construction site. FIG. 6 shows how the housing body 100 is incorporated into a building 132 at a construction site.

The weight of a housing body pre-cast from reinforced concrete with strength of 3000 psi or greater may become quite substantial. To reduce the overall weight of the housing body 100, the floor portion 112 of the housing body 100 may be omitted. If the floor portion 112 is omitted, a floor can be added to the housing body 100 at the construction site. This is done by molding a frame into the bottom of the housing body 100 and welding this frame to a similar frame at a footing in a construction site. Concrete is monolithically poured into the cavity defined by the frame attached to the bottom of the housing body 100 to form a floor.

While the present invention has been described with respect to a limited number of preferred embodiments, those skilled in the art will appreciate numerous modifications and variations therefrom. The appended claims are intended to cover all such modifications and variations which occur to one of ordinary skill in the art.

What is claimed is:

1. A modular vault comprising:

a plurality of side, end, and roof panels connected together to define a walk-in enclosure, each panel pre-cast from a durable material, each panel having an inner surface and defined peripheral edges;

a door frame molded in at least one of the side and end panels;

a door hingedly attached to the door frame, the door controlling access to the walk-in enclosure;

joint means located on the inner surfaces and peripheral edges of the panels, the joint means engaging the panels defining the walk-in enclosure;

a plurality of metal plates attached to the inner surfaces of the panels at a location proximate the peripheral edges, the metal plates being aligned with the peripheral edges; and a plurality of metal connectors welded to the metal plates, the metal connectors sealing corners of the panels and thereby making the walk-in enclosure substantially vapor-tight.

2. The modular vault as claimed in claim 1, further including a floor slab.

3. The modular vault as claimed in claim 2, wherein the floor is pre-cast from a durable material.

4. The modular vault as claimed in claim 1, wherein the durable material is steel-reinforced concrete.

5. The modular vault as claimed in claim 1, wherein the durable material is fire-resistant.

6. The modular vault as claimed in claim 1, wherein the door is provided with bolts and locks.

7. The modular vault as claimed in claim 6, wherein the door is fire-resistant.

8. The modular vault as claimed in claim 1, wherein the joint means are elongated grooves and outwardly extending ridges in the inner surfaces and peripheral edges of the panels, the ridges and grooves mating when the peripheral edges and inner surfaces of the panels abut.

9. The modular vault as claimed in claim 8, wherein each of the grooves is provided with a plurality of apertures for mating with a plurality of metal rods protruding from the ridges.

10. A modular vault comprising:

a plurality of side panels pre-cast from steel-reinforced concrete, each side panel having top, side, and bottom edges, the top and side edges having outwardly extending ridges;

a plurality of end panels pre-cast from steel-reinforced concrete, each end panel having top, side, and bottom edges and an inner surface, the top edge having an outwardly extending ridge, the inner surface provided with a plurality of elongated grooves arranged parallel to the side edges, the elongated grooves mating with the ridges on the side edges of the side panels;

a roof panel pre-cast from steel-reinforced concrete, the roof panel having defined peripheral edges and an inner surface, a plurality of elongated grooves arranged parallel to the peripheral edges, the elongated grooves mating with the ridges on the top edges of the side and end panels;

an enclosure formed between the side, end, and roof panels;

a door frame fixedly mounted in one of the end panels;

a vault door hingedly attached to the door frame, the vault door adapted to control access to the enclosure;

a plurality of metal plates embedded in the side, end, and roof panels, the metal plates aligned with and arranged proximate to the edges of the panels;

a plurality of metal connectors weldedly connected to the metal plates, the metal connectors arranged to seal seams formed between the panels; and means for securely holding the panels together.

11. The modular vault as claimed in claim 10, further including a floor panel.

12. The modular vault as claimed in claim 10, wherein the means for securely holding the abutting panels includes a plurality of metal rods, the metal rods arranged to penetrate the seams formed between the abutting panels.

13. a method of constructing a modular vault at a construction site, comprising the steps of:

placing pre-cast end panels on a footing to form a vertical front wall and a vertical rear wall;

placing pre-cast side panels on the footing to form vertical side walls;

connecting the vertical side walls to the front wall and the rear wall to form an interlocking walk-in space;

welding the seams formed between the walls and between the walls and the footing;

placing a roof slab on top of the connected walls;

welding the seams formed between the connected walls and the roof slab;

welding metal washers to metal rods protruding from the seams formed between the walls and the roof slab; and covering the metal washers and metal rods with grouts.

14. The method as claimed in claim 13, further comprising the step of pouring concrete on the footing in the walk-in space.

15. The method as claimed in claim 13, further comprising the step of lowering a floor slab on the footing in the walk-in space before placing the roof slab on top of the connected walls.

16. The method as claimed in claim 13, wherein the welding step includes welding a metal connector to metal plates embedded in the walls.

* * * * *